United States Patent [19]

Hendricks

[11] 4,135,522

[45] Jan. 23, 1979

[54] VENTILATED SMOKING PIPE

[76] Inventor: David E. Hendricks, Rte. 5, Box 243, Pickens, S.C.

[21] Appl. No.: 806,681

[22] Filed: Jun. 15, 1977

[51] Int. Cl.[2] ..... A24F 5/04

[52] U.S. Cl. ..... 131/198 R

[58] Field of Search ..... 131/198 R, 191, 193

[56] References Cited

U.S. PATENT DOCUMENTS

| | | | |
|---|---|---|---|
| 2,195,522 | 4/1940 | Sorensen | 131/198 R |
| 3,267,941 | 8/1966 | Doppelt | 131/198 R |

FOREIGN PATENT DOCUMENTS

| | | | |
|---|---|---|---|
| 10,411 of | 1893 | United Kingdom | 131/198 |
| 260,077 | 10/1926 | United Kingdom | 131/198 R |
| 423,294 | 1/1935 | United Kingdom | 131/198 R |

*Primary Examiner*—Stephen C. Pellegrino

*Attorney, Agent, or Firm*—Bailey, Dority & Flint

[57] ABSTRACT

A ventilated smoking pipe comprises a bowl having a cavity and an integral stem portion with a short passageway adjacent a bottom portion of the bowl opening into the bowl cavity at one end and into the stem at the remote end. A longitudinal ventilation chamber is formed in the stem communicating with the passageway in the bowl having a substantially uniform cross-section larger than that of the passageway and extending from adjacent the bowl on one end along substantially the entire length of the stem. An air hole is formed in the stem communicating with the ventilation chamber intermediate the end thereof for introducing fresh outside air into the chamber reducing the moisture content and cooling the smoke as it passes through the stem.

4 Claims, 3 Drawing Figures

VENTILATED SMOKING PIPE

Background of the Invention

It has been heretofore proposed to provide an air ventilation hole in the stem of the pipe for permitting air to enter through the air hole and mix with the smoke passing through the stem thus adding a cooling medium to the smoke before entering the mouth of the smoker. However, the prior proposals have dealt primarily with controlling the amount of air admitted to the smoke passageway within the stem such as by utilizing a thermostatic element in U.S. Pat. No. 2,233,287 and have virtually ignored the problem of even blending of the smoke and air inside the pipe stem. U.S. Pat. No. 1,015,723 discloses a pipe having an air ventilation opening in the stem communicating with the smoke passage which includes apparatus for varying the size of the air orifice. However, no attention is directed to the stem construction. Following the admission of air, the flow is immediately constricted by a reduced diameter passage wherein the flow is restricted and necessarily speeded up. This construction is typical of the prior ventilated smoking devices and does not adequately provide for even blending of the air and smoke prior to reaching the mouth of the smoker. The result is often a distinctive hot and cool mixture entering the mouth.

SUMMARY OF THE INVENTION

It has been found that a ventilated smoking pipe can be had which provides for adequate blending of a metered amount of fresh air with the smoke passing through the pipe including a bowl having a cavity for receiving and burning tobacco and a stem integral with the bowl. A removable mouthpiece is open for the passage of smoke and air therethrough having a tip for reception in the mouth and an insert portion remote from the tip for insertion into the stem. An air passageway is formed in a bottom portion of the bowl opening at one end into the bowl cavity and opening at the remote end into the stem. A longitudinal ventilation chamber is formed in the stem communicating with the passageway in the bowl having a substantially uniform cross-section larger than that of the passageway and extending from adjacent the bowl on one end along substantially the entire length of the stem and on the other end thereof receiving the insert portion therein. An air ventilation hole is formed in the stem for communicating with the ventilation chamber intermediate the ends thereof for introducing fresh outside air into the ventilation chamber. The smoke coming from the passageway in the bowl expands in the ventilation chamber wherein its speed is slowed so that the smoke is well blended with the air reducing the moisture content of the smoke and air in the stem and cooling the smoke. The insert portion of the mouthpiece has an interior bore of a cross-sectional area substantially equal to that of the ventilation chamber so that the effective length of the ventilation chamber is essentially unchanged with the mouthpiece inserted therein. Following the introduction of air, the flow continues slowly and virtually uncontracted providing adequate time and conditions for blending of the outside air and smoke.

Accordingly, an important object of the present invention is to provide a ventilated smoking pipe which effectively reduces the moisture content and cools the smoke passing through the pipe so as to present a flavorable smoke to the smoker's mouth.

Another important object of the present invention is to provide a ventilated smoking pipe having a ventilation chamber wherein a metered amount of fresh outside air is introduced and thoroughly and evenly blended with the smoke passing through the chamber.

Another important object of the present invention is to provide a smoking pipe having a ventilation chamber formed along substantially the entire length of the stem wherein the flow of smoke passing through the stem is expanded and slowed providing adequate time and space for thorough blending of the smoke and a metered amount of fresh outside air prior to reaching the smoker's mouth.

Still another important object of the present invention is to provide a ventilated smoking pipe having a precisely formed and sized passageway, air ventilation chamber, air ventilation hole, and mouthpiece passageway which are operationally related and cooperate to increase the results of the ventilation and blending process.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
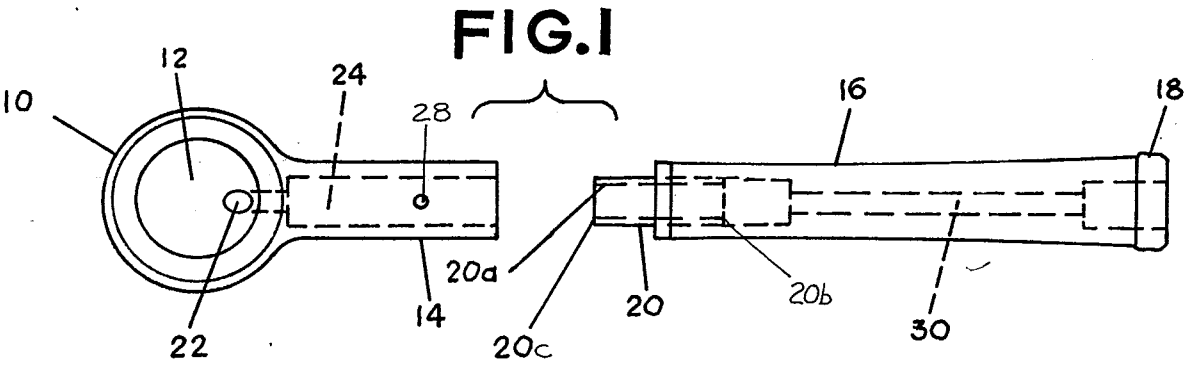
FIG. 1 is a top plan view illustrating a ventilated smoking pipe constructed in accordance with the present invention with the mouthpiece separated from the bowl and stem of the pipe.

The drawing illustrates a smoking pipe having a bowl 10 with a central cavity 12 formed therein for receiving and burning tobacco. A stem 14 is made integral with the bowl 10. As illustrated, the bowl and stem are constructed as one piece as is normally the case from a block of briar wood. A removable mouthpiece is open for the passage of smoke and air therethrough and has a tip 18 for reception in the mouth of the smoker and in insert portion 20 remote from the tip 18 for insertion into the stem 14.

An air passageway 22 is bored in a bottom portion of thhe pipe bowl and extends longitudinally into the stem area. A longitudinal ventilation chamber 24 is bored in the stem 14 communicating with the passageway 22. The ventilation chamber 24 has a substantially uniform cross-section larger than that of the passageway 22. The passageway bore 22 and the ventilation chamber bore 24 join at a junction 26. The ventilation chamber 24 extends from the pipe bowl on one end through the entire length of the stem 14 and on the other end receives the insert portion 20 therein .

An air ventilation hole 28 is formed in the stem 14 communicating with the ventilation chamber 24 intermediate the ends thereof for introducing fresh outside air into the ventilation chamber. The orifice 28 is sized so as to meter a proper amount of air into the ventilation chamber as smoke is drawn therethrough.

As the dryer outside air is thoroughly blended with the smoke, the moisture content is reduced and the resulting mixture of smoke and air delivered to the smoker's mouth is cooled and refreshed.

The mouthpiece 16 is quite different from that normally used in a non-filtered smoking pipe in that the insert portion 20 is provided by a thin-wall aluminum tip having an interior bore 20*a* which protrudes into the briar stem 14 when inserted therein. Due to the thin wall construction, the interior bore 20*a* of the tip is only slightly reduced in cross-section to that of the bore 24 so that, in effect, the overall length of the ventilation chamber 24 in which ventilation and blending occur is not altered with the mouthpiece 16 inserted therein. Insofar as the flow of smoke through the ventilation chamber is concerned, there is little or no interruption of flow through that portion which the bore 20*a* occupies. Thus, the effective length of the ventilating bore 24 is maintained even after insertion of the insert portion 20*a* and the slowed unconstricted blending action is extended toward the rearward end 20*b* of the insert sleeve within the mouthpiece. This is important so thaat there can be additional time and space for blending of the outside air with the smoke downstream of the orifice 28.

Figure 2:
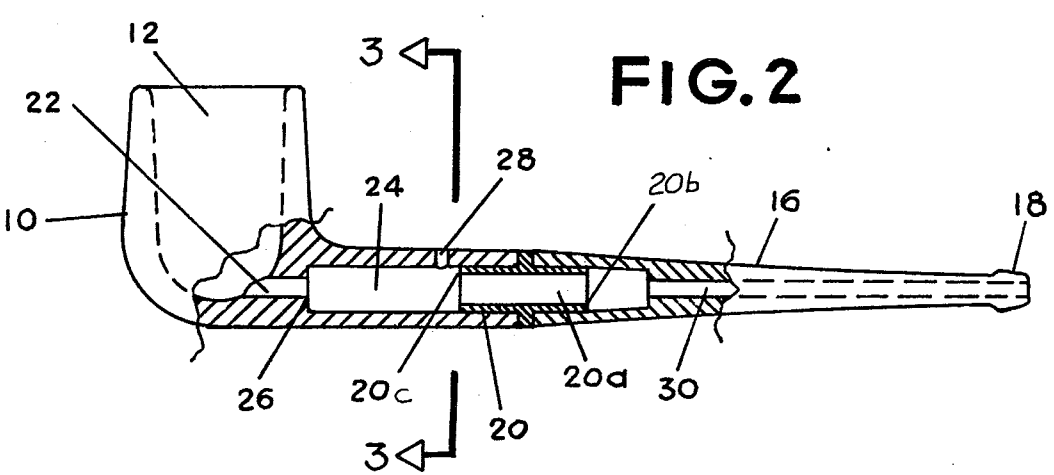
FIG. 2 is a partial cut-away side elevational view illustrating a ventilated smoking pipe constructed in accordance with the present invention.
Figure 3:
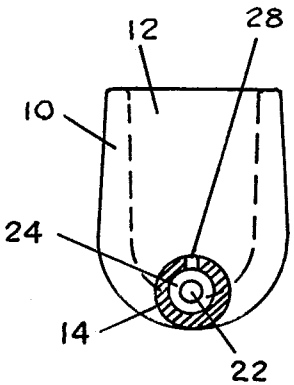
FIG. 3 is a sectional view taken along line 3—3 of FIG. 2.

It is preferred that the free edge 20*c* of the insert portion terminate closely adjacent the air hole 28, as best shown in FIG. 2. The remaining portion of the mouthpiece 16 is preferably a non-bite plastic material and following the bore 20*a* of insert portion 20, the centrally open portion of the mouthpiece is provided by a reduced bore 30 which terminates at the end of tip 18. It is believed to be important to the invention that the air hole 28 be located precisely with respect to the junction 26 and that the flow of smoke and air after passing the air hole 28 be left as unconstricted as possible so that the speed of the flow is not appreciably increased allowing additional time for the blending and cooling of the smoke and air mixture.

The flow of smoke flowing from the bore 22 into the larger bore 24 is thought to experience an abrupt expansion wherein there is some irregular flow followed by resumption of parallel flow. The orifice 28 is believed to be located at a point downstream in the parallel flow region where outside air may be introduced with accuracy and without interference. Thus, the suction placed on the mouthpiece at 18 during smoking would appear at orifice 28 adjacent the free edge of 20*c* of the insert without interference from irregular flow patterns.

It has been found that increased performance can be had by constructing the passageways and bores heretofore discussed within certain critical dimensions whereby the various sizes and shapes thereof cooperate to provide increased and synergistic results. In this regard, the following construction is exemplary of this invention wherein the ventilation chamber 24 begins substantially perpendicular to a plane which is parallel to the side wall of the pipe bowl 10 and extends through to the end of the briar stem portion 14. The length and diameter of the ventilation chamber 24 are thought to be of utmost importance to the proper ventilation of the smoke. The smoke resulting from the burning of tobacco flows serially through the passageway 22 and expands into the ventilation bore 24 having an enlarged diameter relative thereto. The flow is slowed and an easy draw of smoke occurs therethrough providing adequate time for an even blending of smoke and air. The decreased resistance allows a larger quantity of smoke to be more easily drawn through the ventilation chamber. In this construction, it is contemplated that the diameter of air hole 28 be 0.043 inch and that the air hole be positioned 0.625 inch from the junction 26 or the beginning of the ventilation chamber 24. The diameter of the air passageway 22 is 0.156 inch and the diameter of the ventilation chamber 24 is 0.281 inch. With these dimensions in mind, it is contemplated that the overall length of the ventilation chamber 24 would not exceed 1.25 inches.

Thus, it can be seen that an advantageous construction can be had for a ventilated smoking pipe in accordance with the present invention wherein a cool smoke mixture of reduced mosture content is produced. It has been found that 95 percent of the tobacco in the bowl may be burned without experiencing the hot tongue bite which normally occurs in burning the tobacco in the bottom most portion of the bowl.

While a preferred embodiment of the invention has been described using specific terms, such description is for illustrative purposes only, and it is to be understood that changes and variations may be made without departing from the spirit or scope of the following claims.

What is claimed is:

1. A smoking pipe comprising:

a bowl having a cavity for receiving and burning tobacco therein;

a stem integral with said bowl;

a removable mouthpiece open for the passage of air and smoke having a tip for reception in the mouth and an insert portion remote from said tip for insertion into said stem;

a passageway adjacent a bottom portion of said bowl communicating with said bowl cavity;

a longitudinal ventilation chamber in said stem communicating with said passageway having a substantially uniform cross-section larger than that of said passageway and extending from adjacent said bowl on one end along substantially the entire length of said stem and on the other end thereof receiving said insert portion;

an air ventilation hole having a cross-sectional area in the range of 0.00145 to 0.00181 of a square inch formed in said stem communicating with said ventilation chamber intermediate the ends thereof for introducing outside air into said ventilation chamber wherein the smoke and air is evenly blended cooling the smoke passing through said chamber; and said air ventilation hole being located closely adjacent a free edge of said insert portion when received within said stem approximately 0.625 of an inch from a junction of said passageway and ventilation chamber affording substantially unrestricted introduction of air into said ventilation chamber.

2. The structure set forth in claim 1 wherein said air hole has a diameter of 0.043 of an inch.

3. The structure set forth in claim 1 wherein said insert portion has a cross-sectional area substantially equal to that of said ventilation chamber minimizing the constriction of smoke and air flow therethrough.

4. The structure set forth in claim 1 wherein the diameters of said ventilation chamber and said passageway have a ratio of less than two.

* * * * *